US008297329B2

(12) United States Patent
Narita

(10) Patent No.: US 8,297,329 B2
(45) Date of Patent: Oct. 30, 2012

(54) COATING FILM TRANSFER TOOL

(75) Inventor: Yasuo Narita, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 500 days.

(21) Appl. No.: 11/954,821

(22) Filed: Dec. 12, 2007

(65) Prior Publication Data

US 2008/0168944 A1 Jul. 17, 2008

(30) Foreign Application Priority Data

Jan. 12, 2007 (JP) ..... 2007-005079

(51) Int. Cl.
*B65H 35/07* (2006.01)
*B05C 1/14* (2006.01)

(52) U.S. Cl. ..... 156/577; 118/257

(58) Field of Classification Search ..... 156/577
See application file for complete search history.

(56) References Cited

U.S. PATENT DOCUMENTS 3,403,066 A * 9/1968 Ikelheimer ..... 156/577
4,484,702 A * 11/1984 Sabonis et al. ..... 226/74
2003/0047286 A1* 3/2003 Narita ..... 156/577
2003/0062135 A1* 4/2003 Takahashi ..... 156/577

FOREIGN PATENT DOCUMENTS

| | | |
|---|---|---|
| JP | 08-059057 | 3/1996 |
| JP | 3520138 | 7/1997 |
| JP | 10-193882 | 7/1998 |
| JP | 10193882 A * | 7/1998 |
| JP | 2000-238957 | 9/2000 |

OTHER PUBLICATIONS

Translation of JP 10193882 A.*
European Search Report dated Jan. 21, 2009, issued on the corresponding European patent No. 07121798.8.

* cited by examiner

*Primary Examiner* — Dah-Wei Yuan
*Assistant Examiner* — Stephen Kitt
(74) *Attorney, Agent, or Firm* — Edwards Wildman Palmer LLP

(57) ABSTRACT

An arm rotation shaft of a tape base is disposed so as to be in a position on the substantially opposite side to a winding bobbin across a feeding bobbin, one end of a first arm closer than the outer peripheral face of the transfer tape wound around the feeding bobbin is fixed to an arm rotation shaft, and a tape head is provided on the other end of the first arm. By rotation of the first arm taking the arm rotation shaft as a fulcrum, the tape head is rotated.

6 Claims, 10 Drawing Sheets

COATING FILM TRANSFER TOOL

BACKGROUND OF THE INVENTION

1. Field of the Invention

The present invention relates to a coating film transfer tool, and particularly, relates to a coating film transfer tool having a coating film transfer tool replacement holder (a component that forms part of the coating film transfer tool and is configured to be replaceable together with a consumable such as a coating film).

2. Description of the Related Art

Coating film transfer tools used for gluing or correction of typographical errors have been proposed heretofore. A transfer tape of the coating film transfer tool has a peelable transfer film on the surface of a resin tape, a paper tape or the like. With the coating film transfer tool having the resin tape or the like as a medium for conveying the transfer film, a user can glue or correct typographical errors by pressing and applying the transfer film provided on the surface of the tape to an object of transfer.

In general, the coating film transfer tool comprises a supply bobbin, a supply shaft, a head, a winding bobbin, and a winding shaft. Around the supply bobbin, an unused transfer tape is wound. The supply bobbin is mounted on the supply shaft to supply the transfer tape. Over the head for applying the transfer tape to the object of transfer, the transfer tape pulled out of the supply bobbin is tensioned. Around the winding bobbin, the used transfer tape pulled out of the supply bobbin and passed by the head is wound. On the winding shaft, the winding bobbin is mounted.

Conventionally, after using up the unused transfer tape wound around the supply bobbin, the user has discarded a coating film transfer tool main body as a used one. In recent years, however, the user can detach the used transfer tape and mount the unused transfer tape on the coating film transfer tool main body. In other words, the user can reuse the coating film transfer tool main body by replacing the used transfer tape with the unused transfer tape.

There are various types of coating film transfer tools reusable by replacement of the transfer tape. For example, there is a coating film transfer tool having a configuration that replacement members are the supply shaft, the winding shaft, the head, the supply bobbin and the winding bobbin, and that the coating film transfer tool main body is only a cover to which the replacement members are attached.

However, in the coating film transfer tool having the above configuration, most of the members composing the coating film transfer tool are the replacement members. Therefore, even if the user replaces the transfer tape and reuses the coating film transfer tool main body, a main body member that can be reused by the user is only the cover. That is, the conventional replaceable (reusable) coating film transfer tool is not efficient in view of reuse.

On the other hand, for efficient reuse of the coating film transfer tool main body, there is a coating film transfer tool in which only the supply bobbin and winding bobbin are the replacement members. When replacing the transfer tape of this coating film transfer tool, the user firstly mounts the supply bobbin on the supply shaft attached to the coating film transfer tool main body. Next, the user holds a tape part of the transfer tape wound around the supply bobbin, and tensions the tape over the head. Then, the user mounts the winding bobbin on the winding shaft. When replacing the transfer tape of the coating film transfer tool, the user needs to manually tension the flexible transfer tape over the head fixed to the coating film transfer tool. Therefore, an operation of replacing the transfer tape may become troublesome.

Accordingly, in recent years, such a coating film transfer tool has been used, that uses a coating film transfer tool replacement holder comprising the transfer tape and other member. There are various types of replacement holders.

An example of the coating film transfer tool comprising the replacement holder is as described below. The replacement holder comprises the supply bobbin around which the unused transfer tape is wound, the winding bobbin, and the head. The user respectively mounts the supply bobbin and winding bobbin of the replacement holder on a supply shaft and winding shaft disposed to a cover of the coating film transfer tool main body, thereby replacing the transfer tape.

When replacing the replacement holder, the user detaches the holder from the coating film transfer tool main body. Next, the user replaces the holder with a new replacement holder having the supply bobbin around which the unused transfer tape is wound. Therefore, at the time of replacement of the transfer tape of the coating film transfer tool, it is possible to leave the supply shaft and the winding shaft on the coating film transfer tool main body. In other words, in this coating film transfer tool, it is possible to reuse a plurality of members of the coating film transfer tool main body. Moreover, the user can replace the transfer tape only by attachment and detachment of the replacement holder, so that the replacement operation is easy compared with in the conventional coating film transfer tool.

However, when the user replaces the replacement holder, the head is replaced together with the holder and cannot be left on the main body. In replacement of the transfer tape, there is no need to always replace the head. That is, this coating film transfer tool is not efficient in view of reuse of the coating film transfer tool main body. On the other hand, in the coating film transfer tool in which the head is left on the coating film transfer tool main body, a process of tensioning the transfer tape after replacement over the head is troublesome in replacement of the transfer tape.

That is, in the coating film transfer tool, in order to favorably transfer the transfer film to the object of transfer, there is a need to tension the transfer tape over the head in a tense state to some extent. However, it is difficult and considerably troublesome to tension the transfer tape in the tense state from the supply bobbin to the winding bobbin through the head. It is because the transfer tape wound around the supply bobbin in advance is held on the winding bobbin, and the transfer tape having the transfer film has low hardness and is hard to fix in a certain form.

Therefore, the replacement holder requires consideration of efficient reuse of the coating film transfer tool, and satisfaction of the needs to replace with ease and keep the mounted transfer tape in a tense state.

Accordingly, there is a proposal of a coating film transfer tool having a supply shaft, a supply gear, a relay gear, a winding shaft, a winding gear and a head in a coating film transfer tool case composed of two covers facing each other above and below, wherein: these members in the case are disposed to either the upper cover or the lower cover facing each other; when the replaceable supply bobbin and winding bobbin around which the transfer tape is wound are replaced, in accordance with an operation of separating the upper and lower covers, the head of the coating film transfer tool is rotated and housed between the supply shaft and the winding shaft by an arm attached to the supply gear; a peripheral wall of a main body on rotation tracks of the arm and the transfer head is notched; and a part wall fitted with the peripheral wall of the main body is protruded on the upper cover (refer to, for example, Japanese Patent No. 3520138).

The coating film transfer tool disclosed in Japanese Patent No. 3520138 is efficient in view of reuse because only the supply bobbin and winding bobbin are replaced at the time of replacement of the transfer tape. Moreover, it is easy to mount the supply bobbin and the winding bobbin because, at the time of replacement of the transfer tape, the head is housed between the supply shaft and the winding shaft. Furthermore, at the time of use of the coating film transfer tool, the head housed between the supply bobbin and the winding bobbin at the time of replacement is rotated by the arm to return to the initial position, so that it is possible to keep the transfer tape tensioned over the head in a tense state.

However, the coating film transfer tool disclosed in Japanese Patent No. 3520138 has a configuration that the head is housed between the supply shaft and the winding shaft, and the part on the rotation track of the head needs to be protruded so that rotation of the head by the arm is allowed.

According to this configuration, it is necessary to secure a region for housing the head between the supply shaft and the winding shaft at the very least, and secure a region for the head to move on the rotation track of the head, with the result that the coating film transfer tool becomes large in size. The coating film transfer tool larger in size than a certain degree may affect use of the coating film transfer tool, and increase of the length of the transfer tape winding may become difficult.

SUMMARY OF THE INVENTION

In view of the aforementioned problems, an object of the present invention is to reduce a region between a supply shaft and a winding shaft, thereby allowing increase of the length of a transfer tape winding and allowing prevention of a coating film transfer tool from becoming large in size. Further, another object of the present invention is to provide a coating film transfer tool in which replacement of a coating film transfer tool replacement holder can be performed with ease and efficiency from the viewpoint of reuse, and that a tape tensioned over a head does not loosen after the replacement.

In order to solve the aforementioned problems, the present invention provides a coating film transfer tool comprising: a coating film transfer tool main body; and a replacement member including a tape, wherein: the replacement member has: a supplier of an unused tape; a collector of a used tape; and a tape holder which is placed at an end away from the supplier and the collector, and over which the tape fed from the supplier and collected by the collector is tensioned; and the coating film transfer tool main body has: a rotation mechanism rotatably supporting the supplier and the collector of the replacement member when the replacement member is mounted on the coating film transfer tool; a tape head rotation shaft placed in a position corresponding to the end of the replacement member, on the coating film transfer tool main body; and a tape head which, when an operation of mounting the replacement member is performed, rotates taking the tape head rotation shaft as a fulcrum in a region surrounded by a passage of the tape fed from the mounted supplier to the mounted collector and the position corresponding to the end on the coating film transfer tool main body, and makes the tape collected by the collector tensioned instead of the tape holder.

Further, the present invention provides a coating film transfer tool comprising: a replacement base member which rotatably supports a feeding bobbin having a tape previously wound therearound and a winding bobbin winding up the tape at one end of each of the bobbins, on a surface orthogonal to an axial direction of the bobbins; and a base member supporting on one surface an interlock mechanism which supports a feeding support engaged with the inside of the feeding bobbin and a winding support engaged with the inside of the winding bobbin at one end of each of the supports and which rotates the supports in cooperation, the replacement base member being mounted on the base member by inserting the feeding support and winding support of the base member into the feeding bobbin and winding bobbin of the replacement base member, respectively, from a side of the other end of each of the bobbins, and a coating film adhered to the tape being transferred to an object of transfer, the coating film transfer tool comprising: a tape head supported by a first arm member so as to be rotatable taking, as a fulcrum, a rotation shaft disposed on the one surface of the base member so as to be orthogonal thereto within a predetermined angle range with respect to a line elongated through the feeding support from the winding support, the first arm member being shorter in length than a distance between the fulcrum and the tape wound around the feeding bobbin; and a tape guide disposed on the one surface of the mounted replacement base member so as to be rotated by a second arm taking a position facing a base of the rotation shaft as a fulcrum, the second arm being substantially equal in length to the first arm member, the tape guide being engaged with the rotation shaft so as to be positioned symmetrically with a tip of the tape head with respect to the rotation shaft in a direction in which the first arm member extends when the replacement base member is mounted, wherein: the tape is tensioned over either the tape head or tape guide rotated to be placed at a tip of the coating film transfer tool.

The coating film transfer tool according to the present invention comprises the replacement member having: the supplier of the unused tape; the collector of the used tape; and the tape holder which is placed at the end away from the supplier and the collector, and over which the tape fed by the supplier and collected by the collector is tensioned. Further, the coating film transfer tool main body has: the tape head rotation shaft placed in the position corresponding to the end on the coating film transfer tool main body; and the tape head which, when the operation of mounting the replacement member is performed, rotates taking the tape head rotation shaft as the fulcrum in the region surrounded by the passage of the tape fed from the mounted supplier to the mounted collector and the position corresponding to the end on the coating film transfer tool main body, and makes the tape tensioned instead of the tape holder.

Accordingly, by rotating the tape head between the end of the coating film transfer tool and the passage of the tape, and switching a position for holding the tape between the tape head and the tape holder, it is possible to switch a tensioning state of the tape between a tense state and a loose state without broadening a space between the mounted supplier and collector. Consequently, easy replacement of the coating film transfer tool is allowed without making the coating film transfer tool larger in size, and the tape tensioned over the tape head does not loosen after the replacement. Moreover, the head disposed to the base member is efficient for the replacement from the viewpoint of reuse. Besides, it becomes possible to increase the length of a tape winding wound around the bobbin.

Further, the coating film transfer tool according to the present invention comprises the replacement base member having: the feeding bobbin around which the tape is previously wound; the winding bobbin winding up the tape; and the second arm rotatably disposed and provided with the tape guide. Moreover, when the replacement base member is mounted on the coating film transfer tool, the tape guide is engaged with the rotation shaft so as to be positioned symmetrically with the tip of the tape head supported by the first arm member so as to be rotatable taking, as the fulcrum, the rotation shaft disposed to the base member of the coating film transfer tool, whereby the tape head and the tape guide can rotate together. Since the tape head and the tape guide rotate together, the tape of the coating film transfer tool is tensioned over either the tape head or tape guide placed at the tip.

Thus, the tape head rotates taking, as the fulcrum, the rotation shaft disposed within the predetermined angle range with respect to the line elongated through the feeding support from the winding support, and the position for holding the tape is switched between the tape head and the tape guide, whereby it becomes possible to switch the tensioning state of the tape between the tense state and the loose state without broadening the space between the feeding bobbin and the winding bobbin. Therefore, easy replacement of the coating film transfer tool replacement holder is allowed without making the coating film transfer tool larger in size, and the tape tensioned over the head does not loosen after the replacement. Moreover, the head disposed to the base member is efficient for the replacement from the viewpoint of reuse. Furthermore, it becomes possible to increase the length of a tape winding wound around the bobbin.

DETAILED DESCRIPTION OF THE PREFERRED EMBODIMENT

Entire Configuration

Figure 1:
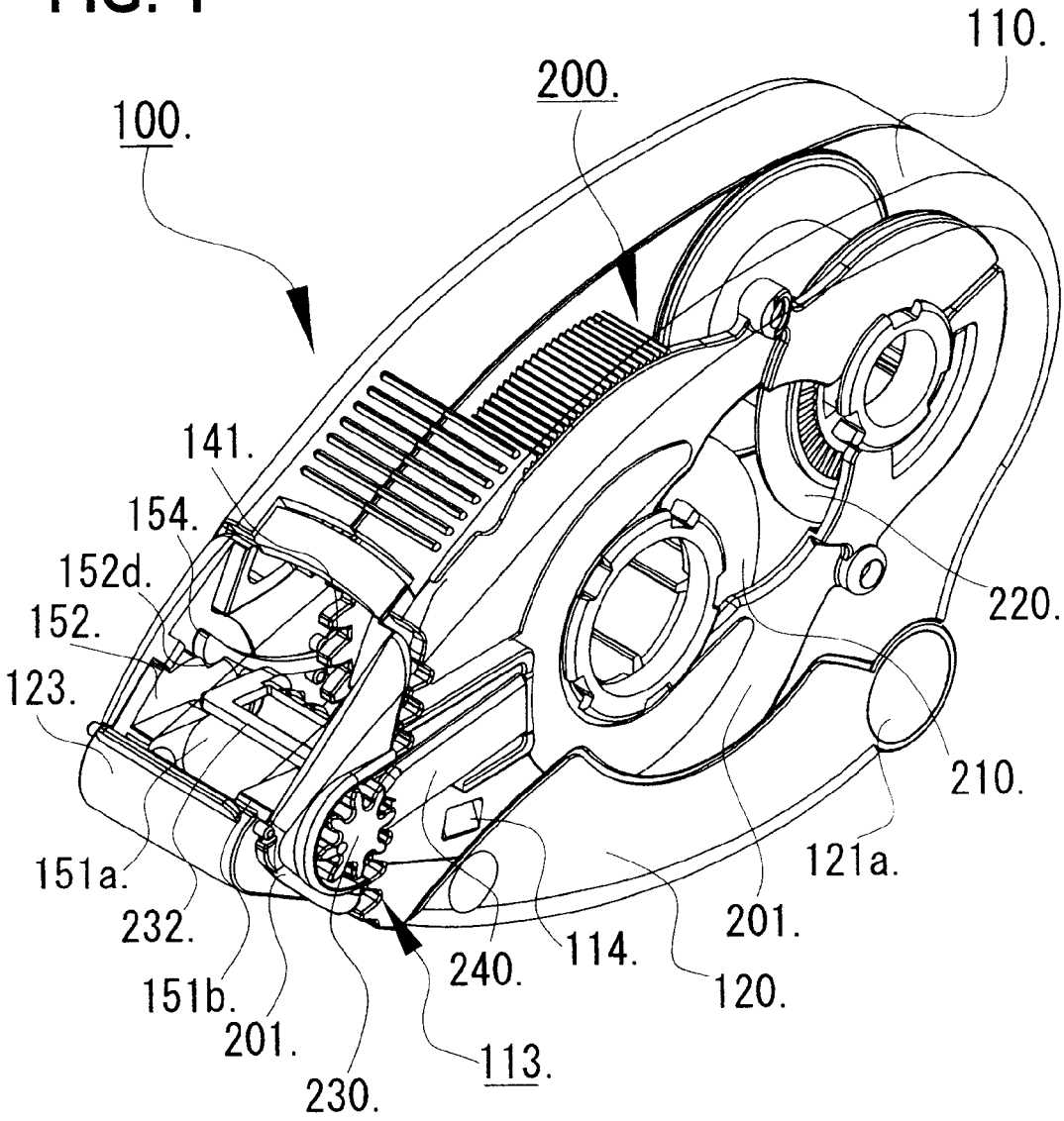
FIG. 1 is a perspective view illustrating the appearance of a coating film transfer tool according to an embodiment of the present invention.

The configuration of a coating film transfer tool and a coating film transfer tool replacement holder according to a first embodiment of the present invention will be briefly described referring to FIGS. 1-5. FIG. 1 is a schematic perspective view illustrating the appearance of the coating film transfer tool according to the present embodiment. FIG. 2A is a view illustrating a state in which a main cover of the coating film transfer tool according to the present embodiment is closed. FIG. 2B is a view illustrating a state in which the main cover of the coating film transfer tool according to the present embodiment is opened to replace the replacement holder. FIG. 2C is a view illustrating a state in which the main cover of the coating film transfer tool according to the present embodiment is opened and the replacement holder is detached. FIG. 3A is a view illustrating a state in which, in the coating film transfer tool according to the present embodiment, a tape head is positioned at a tip of the coating film transfer tool and a transfer tape is tensioned over the tape head. FIG. 3B is a view illustrating a state in which, in the coating film transfer tool according to the present embodiment, the tape head and a tape guide are interchanging. FIG. 3C is a view illustrating a state in which, in the coating film transfer tool according to the present embodiment, the tape guide is positioned at the tip of the coating film transfer tool and the transfer tape is tensioned over the tape guide.

Figure 2A:
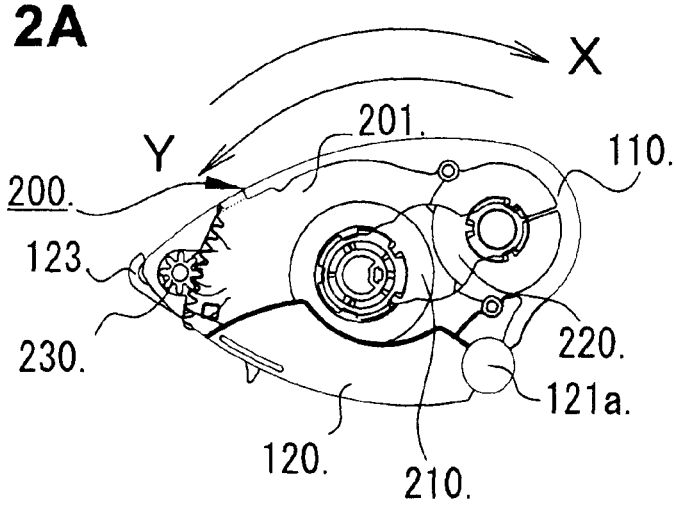
FIG. 2A is a view illustrating a state in which a main cover is closed in the coating film transfer tool according to the present embodiment.
Figure 2B:
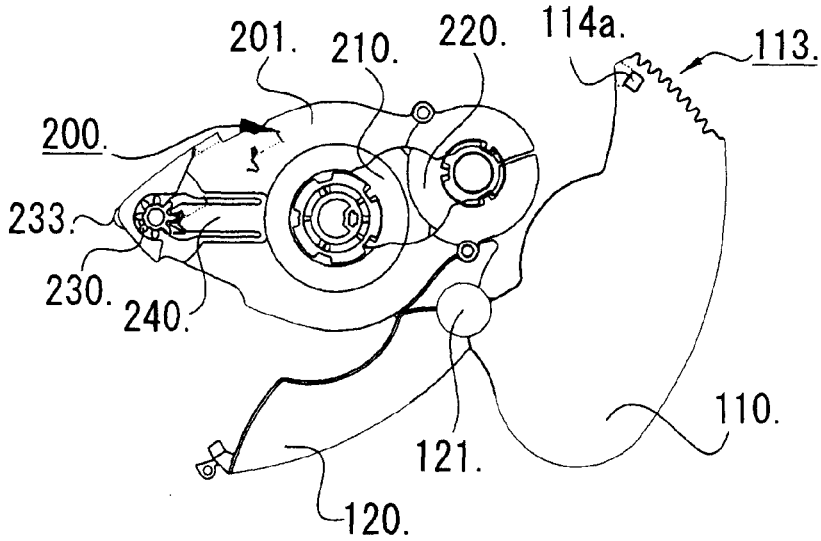
FIG. 2B is a view illustrating a state in which the main cover is opened to at the time of replacement of the replacement holder in the coating film transfer tool according to the present embodiment.

As illustrated in FIGS. 1 and 2, a main case 100 forming the outside of a coating film transfer tool 1 according to the present embodiment includes a first cover 110 and a second cover 120. On both ends of a case rotation shaft (an integration of shaft parts 111*a* and 111*b* illustrated in FIG. 6) disposed to the first cover 110, fitting parts 121*a* and 121*b* are fitted. Consequently, as illustrated in FIG. 2B, it is possible to rotate the first cover 110 and the second cover 120 in the opposite directions to each other (refer to FIG. 2B) taking the case rotation shaft as an axial center, thereby opening the main case 100.

Figure 4:
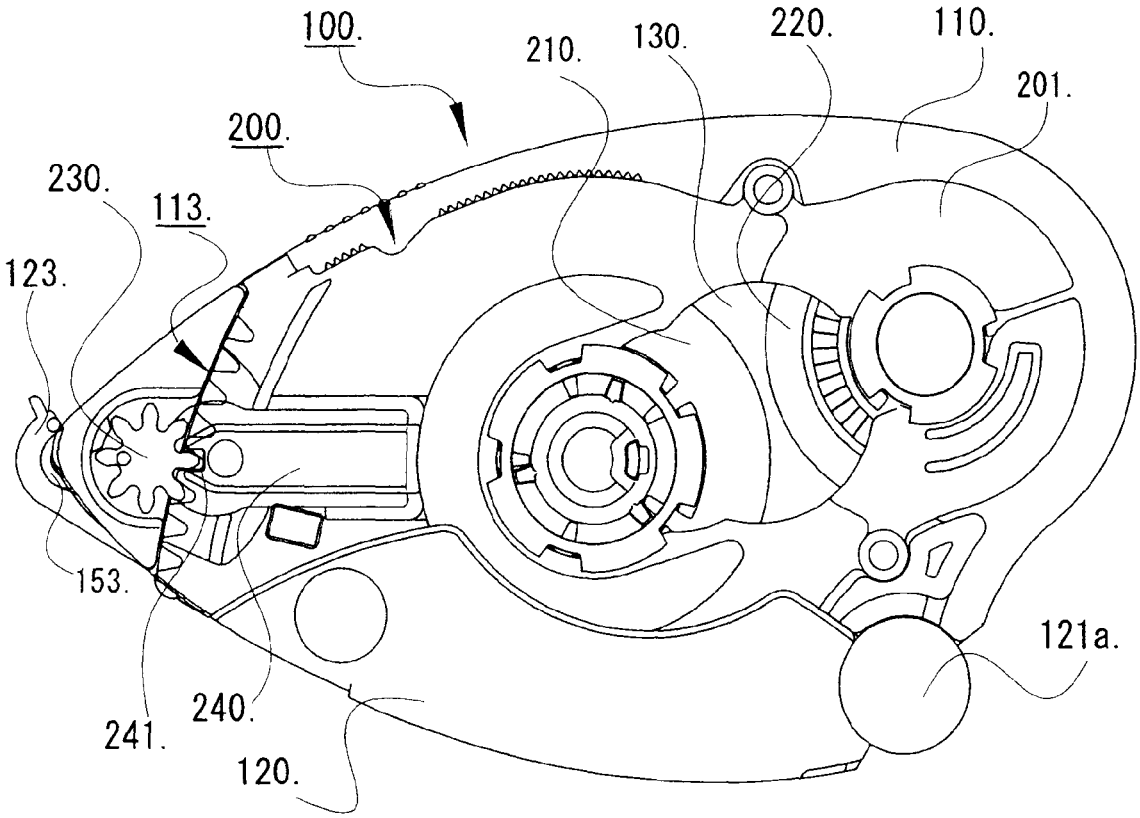
FIG. 4 is a front view of the coating film transfer tool in the present embodiment.
Figure 5:
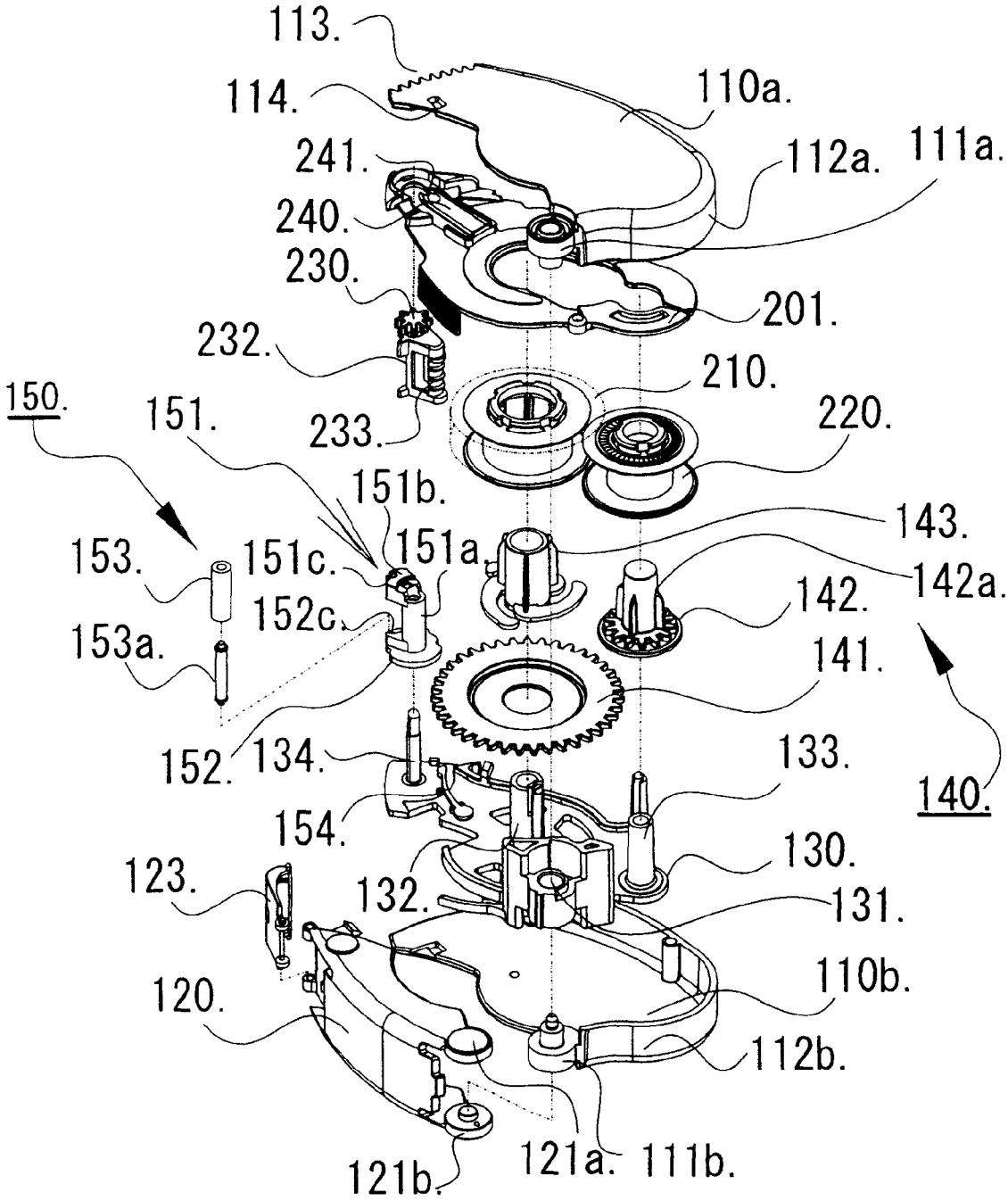
FIG. 5 is an exploded perspective view illustrating components and a coupling relation thereof of the coating film transfer tool in the present embodiment.
Figure 6:
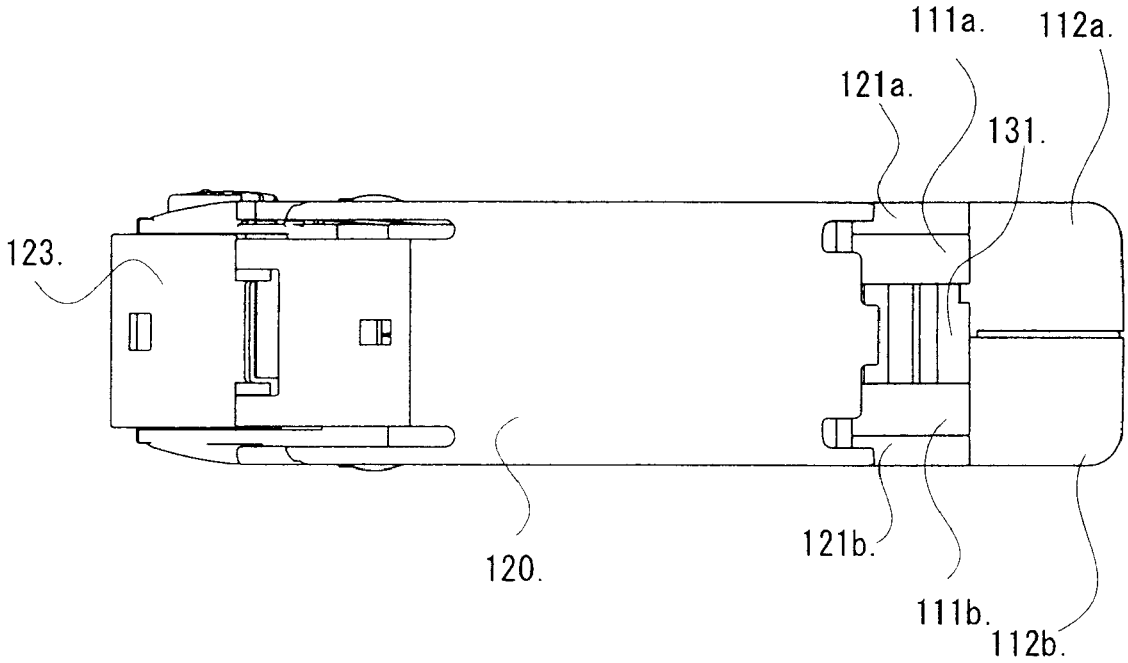
FIG. 6 is a bottom view of the coating film transfer tool in the present embodiment taken from a second cover side.

Next, the internal configuration of the coating film transfer tool 1 will be described referring to FIG. 1 and FIGS. 3-6. FIG. 4 is a schematic front view of the coating film transfer tool according to the present embodiment. FIG. 5 is an exploded perspective view illustrating the components of the coating film transfer tool 1 according to the present embodiment and a coupling relation of the components. FIG. 6 is a bottom view taken from the second cover 120 side of the coating film transfer tool according to the present embodiment.

As illustrated in FIG. 4, the coating film transfer tool 1 has a configuration that a replacement holder 200 having two bobbins (210 and 220) around each of which a transfer tape is wound is mounted on a tape base 130 placed inside the main case 100. This tape base 130 is equivalent to one example of the "base member" according to the present invention (refer to FIG. 2C). The replacement holder 200 is equivalent to one example of the "replacement member" according to the present invention. Moreover, as illustrated in FIGS. 5 and 6, the tape base 130 is rotatably supported in a state where the case rotation shaft of the first cover 110 is fitted into a holding hole 131. As illustrated in FIG. 2B, the replacement holder 200 is configured by attaching a feeding bobbin 210 and a winding bobbin 220 to a replacement base 201. The replacement base 201 further has a driving gear 230, a tape guide 233 interlocked with the driving gear 230, and a second lock mechanism 240. A detailed configuration of the replacement holder 200 will be described later. The feeding bobbin 210 is equivalent to one example of the "supplier" according to the present invention. The winding bobbin 220 is equivalent to one example of the "collector" according to the present invention. The replacement base 201 is equivalent to one example of the "replacement base member" according to the present invention.

Figure 2C:
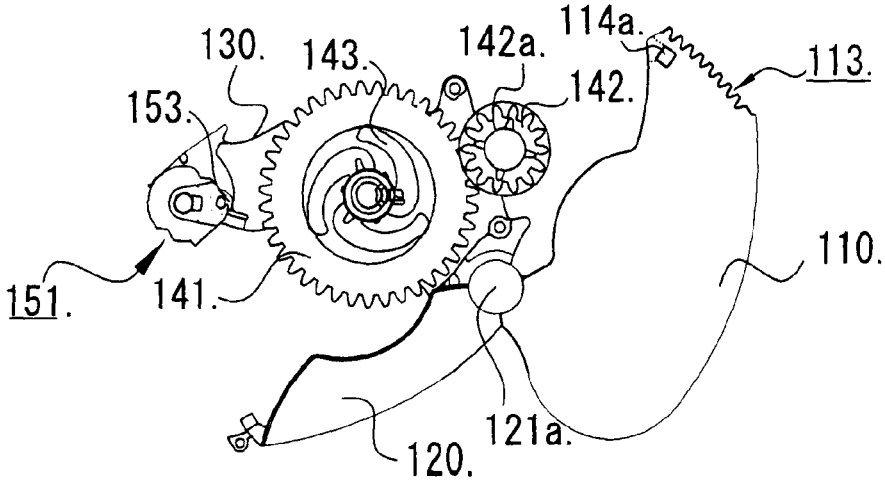
FIG. 2C is a view illustrating a state in which the main cover is opened and the replacement holder is detached in the coating film transfer tool according to the present embodiment.

By taking the case rotation shaft (111*a* and 111*b* illustrated in FIG. 6) of the first cover 110 as an axial center (refer to FIG. 2B) to open the main case 100, it is possible to bring the replacement holder 200 into an attachable/detachable state (refer to FIGS. 2B and 2C). Moreover, with the case rotation shaft of the first cover 110, it is possible to keep a constant engagement relation between an engagement groove 113 described later and the driving gear 230.

The tape base 130 protrudes from an opening (an end including the engagement groove 113 in FIG. 1) of the main case 100 containing the tape base 130. As illustrated in FIG. 5, at a protruding end of the tape base 130, an arm rotation shaft 134 placed upright from the tape base 130 is formed. This arm rotation shaft 134 is equivalent to one example of the "head rotation shaft" and the "rotation shaft" according to the present invention. A feeding shaft 132 is formed near the center on a surface with the arm rotation shaft 134 formed of the tape base 130. Moreover, a winding shaft 133 is formed at an end on the substantially opposite side to the arm rotation shaft 134 on the tape base 130. Furthermore, as illustrated in FIG. 5, a first arm 151 provided with a tape head 153 is mounted on the arm rotation shaft 134.

On the tape base 130, the feeding bobbin 210 is fitted on the feeding shaft 132 and the winding bobbin 220 is fitted on the winding shaft 133, whereby the replacement holder 200 is mounted on the tape base 130. Moreover, on one surface of the replacement base 201, at the opposite end across the feeding bobbin 210 to an end where the winding bobbin 220 is coupled, a second arm 232 is placed upright in the same direction as the feeding bobbin 210 and the winding bobbin 220. The second arm 232 is mounted on the first arm 151 in conjunction with the replacement holder 200 being mounted.

Further, as illustrated in FIG. 1, on the replacement holder 200, the driving gear 230 is formed on a surface on the opposite side to the second arm 232 across the replacement base 201. The driving gear 230 has a pipe 231 (refer to FIG. 9B) formed by piercing the replacement base 201 from the driving gear 230, and is connected to the second arm 232 through the pipe 231. Moreover, the driving gear 230, the pipe 231, and the second arm 232 rotate in one body. This pipe 231 is equivalent to one example of the "pipe-like rotation member" according to the present invention.

Next, referring to FIGS. 2 and 3, a main case and an arm driving mechanism 150 of the coating film transfer tool will be briefly described.

The coating film transfer tool is configured so that the tape base 130 is opened from the main cover 100 by rotating and separating the first cover 110 and the second cover 120 as illustrated in FIGS. 2A and 2B and the replacement holder 200 can be attached/detached as illustrated in FIGS. 2B and 2C.

Figure 3A:
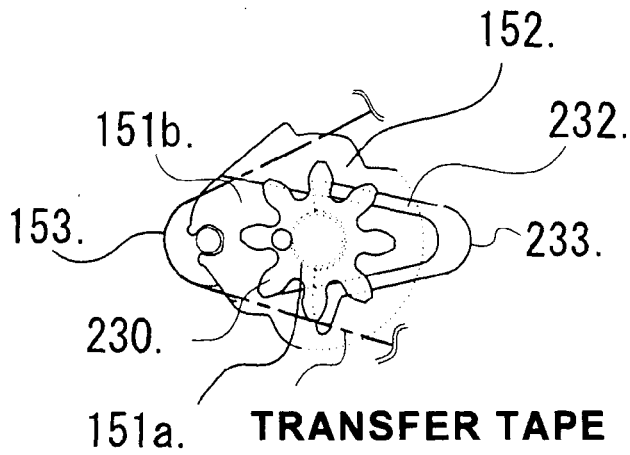
FIG. 3A is a view illustrating a state in which, in the coating film transfer tool according to the present embodiment, a tape head is positioned at a tip of the coating film transfer tool and a transfer tape is tensioned over the tape head.

In the coating film transfer tool according to the present embodiment, when the main cover 100 is closed and the first cover 110 and the second cover 120 abut on each other (FIG. 2A), the tape head 153 is positioned at the tip of the tape base 130, and the transfer tape is tensioned over the tape head 153 (FIG. 3A). At this moment, the tape guide 253 of the replacement holder 200 is placed facing almost the center of the replacement holder 200 and the tape base 130.

When the first cover 110 and the second cover 120 start to separate from each other, the engagement groove 113 of the first cover 110 rotate the driving gear 230 of the replacement holder 200 in a state where the main cover 100 houses part of the tape base 130. Consequently, the first arm 151 and the second arm 232 mounted on the first arm 151 rotate. With rotation of the second arm 232, the tape head 153 held by the first arm 151 rotates toward the center of the tape base 130 (in the y-direction of FIG. 2A). That is, the tape head 153 and the tape guide 233 interchange through a state illustrated in FIG. 3B as the coating film transfer tool in the state illustrated in FIG. 2A is brought into a state illustrated in FIG. 2B.

A rotation range of the first arm 151 and the second arm 232 is a range surrounded by a passage of the transfer tape from the feeding bobbin 210 to the winding bobbin 220 through the tape head 153 (or through the tape guide 233), in the vicinity of the tip of the tape base 130 protruding from the main cover 100 (a position corresponding to the end of the replacement holder 200).

Figure 3B:
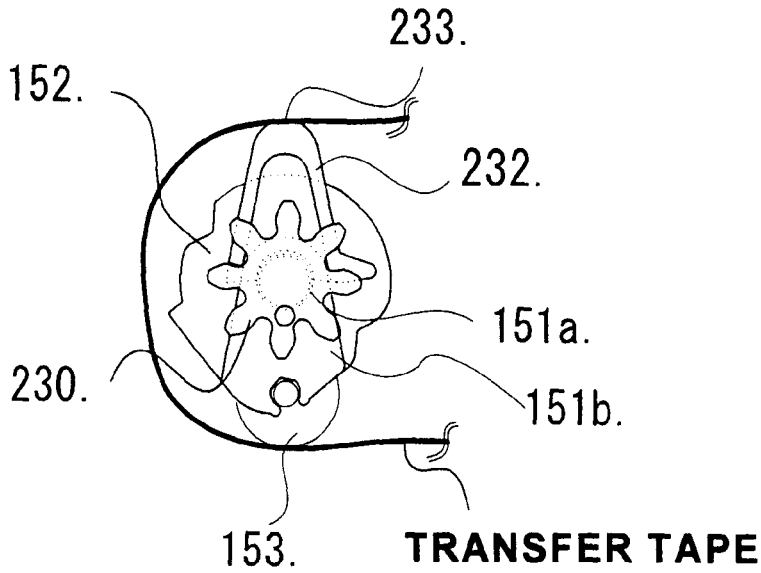
FIG. 3B is a view illustrating a state in which, in the coating film transfer tool according to the present embodiment, the tape head and a tape guide are interchanging.
Figure 3C:
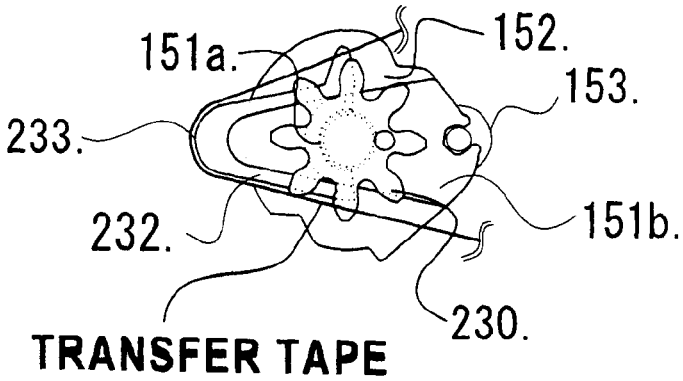
FIG. 3C is a view illustrating a state in which, in the coating film transfer tool according to the present embodiment, the tape guide is positioned at the tip of the coating film transfer tool and the transfer tape is tensioned over the tape guide.

As illustrated in FIGS. 2B and 2C, the first cover 110 and the second cover 120 separate from each other, and the main cover 100 opens, whereby the tape base 130 is opened. In a state where the tape base 130 is opened, as illustrated in FIG. 3C, the tape guide 233 of the replacement holder 200 is placed at the tip of the tape base 130, and the transfer tape is tensioned over the tape guide 233. At this moment, the tape head 153 interchanges with the tape guide 233 to be placed facing almost the center of the tape base 130.

When the coating film transfer tool in a state where the replacement holder 200 is not mounted on the tape base 130 (FIG. 2C) is brought into a state where the replacement holder 200 is mounted (FIG. 2B), and subsequently, the first cover 110 and the second cover 120 come close to each other (FIG. 2A), the engagement groove 113 rotates the driving gear 230. Consequently, the first arm 151 and the second arm 232 rotate, and the tape guide 233 rotates toward the center of the tape base 130 (in the x-direction in FIG. 2A). In other words, as the coating film transfer tool in the state of FIG. 2B is brought into the state of 2A, the tape guide 233 and the tape head 153 interchange as illustrated in FIG. 3B. This operation of shifting from the state of FIG. 2B to the state of FIG. 2A is equivalent to one example of the "mounting operation" according to the present invention.

As described above, in the coating film transfer tool according to the present embodiment, in a state where the main case 100 is closed, the transfer tape fed from the feeding bobbin 210 is tensioned over the tape head 153 of the tape base 130. At the time of replacement of the transfer tape, the main cover 100 is opened to detach the replacement holder 200, whereby the first arm 151 holding the tape head 153 rotates taking the arm rotations shaft 134 as a fulcrum, and the tape head 153 and the tape guide 233 held by the second arm 232 of the replacement holder 200 interchange. Interchange of the tape guide 233 and the tape head 153 facilitates attachment/detachment of the replacement holder 200. Below, the coating film transfer tool according to the present embodiment will be described in detail.

Configuration of Each Component

Next, the configuration of each component and each part of the coating film transfer tool and the coating film transfer tool replacement holder according to the present embodiment will be described referring to FIGS. 1-9.

Configuration of First Cover

Figure 7A:
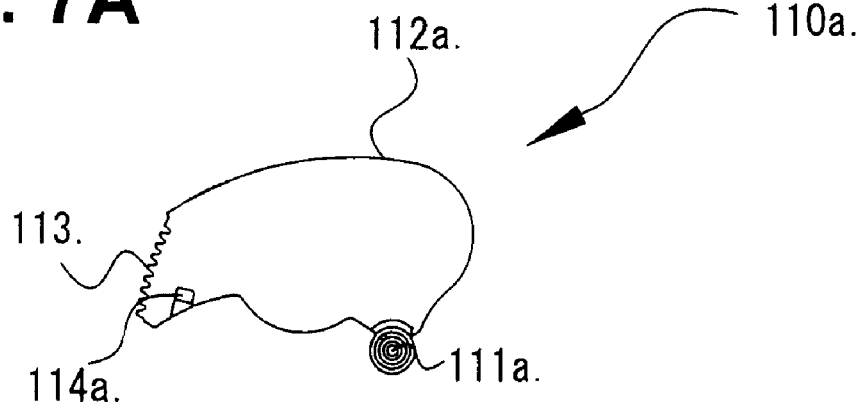
FIG. 7A is a view of a driving cover of the first cover of the coating film transfer tool in the present embodiment, taken from outside.
Figure 7B:
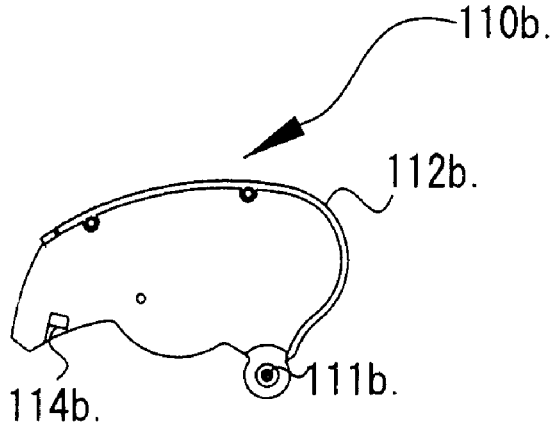
FIG. 7B is a view of a housing cover of the first cover of the coating film transfer tool in the present embodiment, taken from inside.

The first cover 110 will be described referring to FIGS. 7A and 7B. FIG. 7A is a view of a driving cover 110*a* of the first cover 110 taken from outside. FIG. 7B is a view of a housing cover 110*b* of the first cover 110 taken from inside.

As illustrated in FIGS. 5, 7A and 7B, the first cover 110 is composed of a combination of the driving cover 110*a* and the housing cover 110*b* facing each other, each composed of a transparent member. Outer peripheral parts of the driving cover 110*a* and housing cover 110*b* have peripheral wall parts 112*a* and 112*b* protruding in a direction substantially orthogonal to surfaces facing each other (refer to FIGS. 5, 7A and 7B).

As illustrated in FIGS. 5 and 7A, the peripheral wall part 112*a* of the driving cover 110*a* is formed to the shape of the outer peripheral part of the driving cover 110*a*. Moreover, the peripheral wall part 112*a* has a shaft part 111*a* at one end. Further, as illustrated in FIG. 5, the peripheral wall part 112*a* is provided with an engagement groove 113 composed of a plurality of grooves engaged with the driving gear 230, at an end opposite to the shaft part 111*a*. The plurality of grooves of the engagement groove 113 are formed so that the depth and width thereof determine the rotation amount of the driving gear 230 described later. The rotation amount will be described later.

Further, as illustrated in FIG. 5, a fixing hole 114*a* fixing the second cover 120 is disposed to a part of the driving cover 110*a* abutting on the second cover 120, on the opposite side to the shaft part 111*a*.

As illustrated in FIGS. 5 and 7B, the housing cover 110*b* is formed so as to be symmetric with the driving cover 110*a*. Moreover, the housing cover 110*b* is provided with a shaft part 111*b*, a peripheral wall part 112*b* and a fixing hole 114*b*. The housing cover 110*b* is not provided with an engagement groove.

The driving cover 110*a* and the housing cover 110*b* are combined so that the peripheral wall part 112*a* and the peripheral wall part 112*b* face and abut on each other in the protruding direction, whereby the first cover 110 is formed. Moreover, by combining the driving cover 110*a* and the housing cover 110*b*, the shaft part 111*a* and the shaft part 111*b* face each other, and the aforementioned case rotation shaft is formed.

Configuration of Second Cover

Figure 7C:
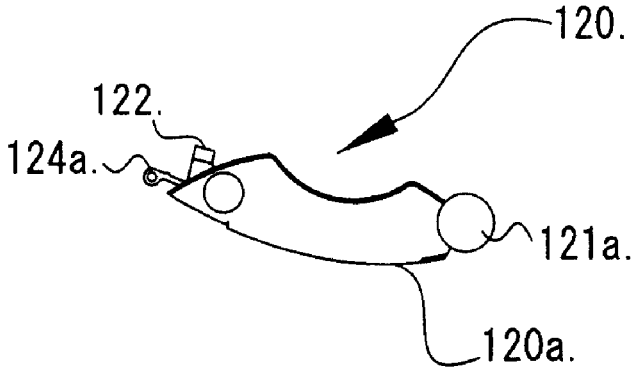
FIG. 7C is a front view illustrating the second cover 120 of the coating film transfer tool in the present embodiment.

The second cover 120 will be described referring to FIGS. 3, 5 and 7C. FIG. 7C is a front view illustrating the second cover 120 of the coating film transfer tool according to the present embodiment.

The second cover 120 is formed by uniting a pair of flat faces facing each other (FIG. 7C) with a peripheral wall 120*a* protruding in a direction orthogonal to the flat faces so as to connect outer peripheral parts of the flat faces (FIGS. 5 and 7C).

The second cover 120 has fitting parts 121*a* and 121*b* at one ends of the flat faces. As illustrated in FIG. 5, the fitting parts 121*a* and 121*b* are fitted into the shaft parts 111*a* and 111*b* while holding the shaft parts therebetween. Consequently, the second cover 120 can rotate taking the respective fitting parts 121*a* and 121*b* as rotation shafts.

Further, as illustrated in FIGS. 5 and 7C, hooks 122 and 122 hooked in the fixing holes 114*a* and 114*b* of the first cover 110 are disposed at ends opposite to the fitting parts 121*a* and 121*b* of the second cover 120. By making the first cover 110 and the second cover 120 abut on each other, the hooks 122 and 122 are hooked in the fixing holes 114*a* and 114*b* of the first cover 110, respectively.

Consequently, the first cover 110 and the second cover 120 are inhibited from rotating in a direction to separate from each other (refer to FIG. 1). In other words, such a case is prevented that the main case 110 opens during use of the coating film transfer tool. On the other hand, by unhooking both the hooks 122, it is possible to open the main case 100 to replace the transfer tape.

Further, as illustrated in FIG. 5, a cap 123 is disposed near the hooks 122 of the second cover 120. This cap 123 rotates with one end axially supported on the second cover 120. Moreover, as illustrated in FIGS. 3 and 5, the cap 123 can house a tape head 153 described later. Accordingly, it is possible to prevent such a case that a coating film (a coating film for correction, a coating film of glue, etc.) adhered to the transfer tape are mistakenly transferred while the coating film transfer tool is not used.

Configuration of Tape Base

Figure 8A:
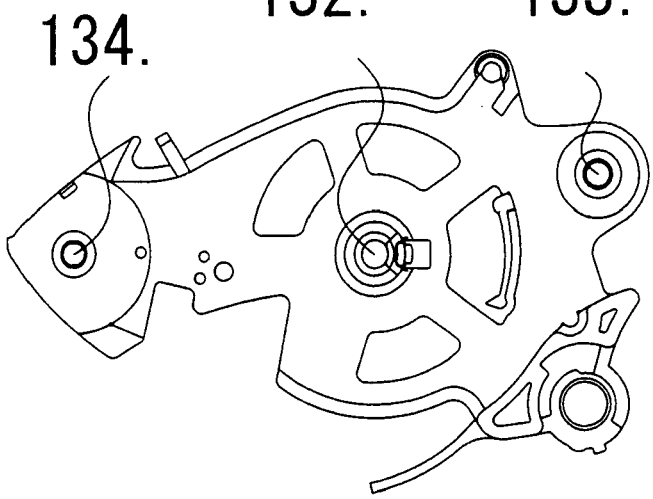
FIG. 8A is a front view illustrating a tape base of the coating film transfer tool in the present embodiment.

The tape base 130 will be described referring to FIG. 8A. FIG. 8A is a front view illustrating a tape base of the coating film transfer tool according to the present embodiment. The tape base 130 according to the present embodiment is used to mount the replacement holder 200 on the coating film transfer tool main body, and is housed within the main case 100 together with the replacement holder 200.

As illustrated in FIGS. 5 and 8A, the feeding shaft 132 on which the feeding bobbin 210 described later is fit is placed upright at the center of one face of the tape base 130. Moreover, the winding shaft 133 on which the winding bobbin 210 described later is fit is placed upright at one end on the one face of the tape base 130. Furthermore, the arm rotation shaft 134 is disposed to the other end on the one face. Specifically, as illustrated in FIG. 8A, the arm rotation shaft 134 is disposed within a predetermined angle with respect to a line elongated from the center of the winding shaft 133 through the center of the feeding shaft 132. This predetermined angle is an angle that allows the transfer tape tensioned over the tape head 153 from the feeding bobbin 210 described later and reaching the winding bobbin 220 to come in contact with the outer peripheral face of the transfer tape wound around the feeding bobbin 210.

Further, the holding hole 131 into which the shaft parts 111*a* and 111*b* are fitted is disposed around the winding shaft 133 on the outer periphery of the tape base 130.

Configuration of Bobbin Driving Mechanism

Next, a bobbin driving mechanism will be briefly described referring to FIG. 5.

As illustrated in FIG. 5, a bobbin driving mechanism 140 comprises a feeding gear 141, a winding gear 142, and a clutch mechanism 143. The feeding gear 141 and winding gear 142 are respectively mounted, via attachment holes formed at the centers thereof, on the feeding shaft 132 and winding shaft 133 of the tape base 130. The bobbin driving mechanism 140 is equivalent to one example of the "rotation mechanism" according to the present invention.

The feeding gear 141 is used for transmitting rotational force of the feeding bobbin 210 described later to the winding gear 142. That is, the feeding gear 141 is engaged with the winding gear 142 to rotate the winding gear 142. Further, as illustrated in FIGS. 2C and 5, the clutch mechanism 143 has a through hole, and can be fitted on the feeding shaft 132. This clutch mechanism 143 transmits rotational force of the feeding bobbin 210 to the feeding gear 141. Since the feeding gear 141 directly meshes with the winding gear 142, the rotational force is transmitted to the winding gear 142, and the winding gear 142 is rotated.

As illustrated in FIG. 5, the winding gear 142 has, at the center thereof, a driving pipe 142*a* orthogonal to the face of the winding gear 142 and having a through hole. The through hole is formed so that the driving pipe 142*a* can be fitted on the winding shaft 133. Further, the driving pipe 142*a* transmits rotational force of the winding gear 142 to the winding bobbin 220.

Configuration of Arm Rotation Mechanism

Figure 8B:
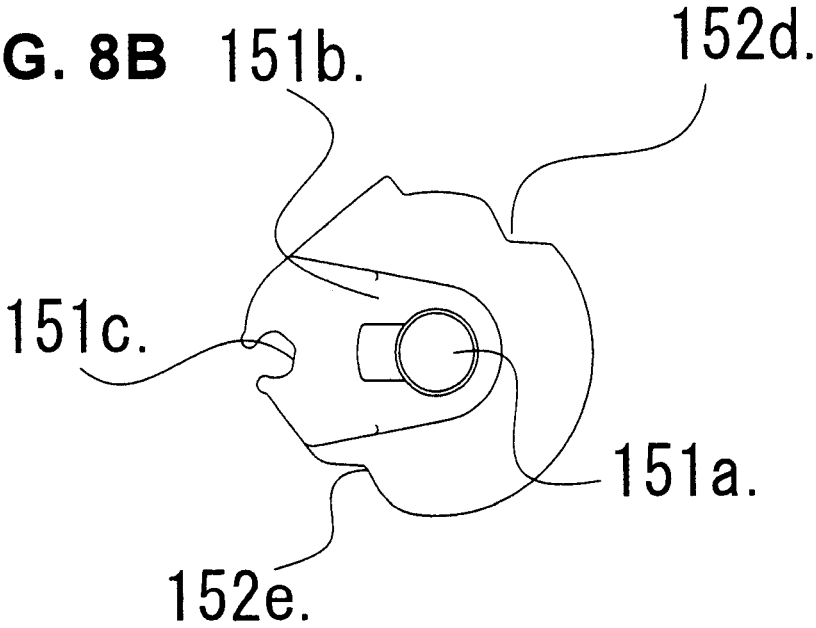
FIG. 8B is a view illustrating the arm driving mechanism of the coating film transfer tool according to the present embodiment.
Figure 8C:
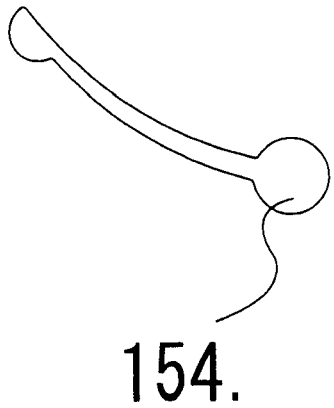
FIG. 8C is a view illustrating an engagement piece in the arm driving mechanism of the coating film transfer tool according to the present embodiment.

Next, the arm driving mechanism will be described referring to FIGS. 5, 8B and 8C. FIG. 8B illustrates the arm driving mechanism 150 of the coating film transfer tool according to the present embodiment. FIG. 8C illustrates part of a first lock mechanism regulating the rotational amount of the first arm in the arm driving mechanism of the coating film transfer tool according to the present embodiment.

As illustrated in FIG. 5, the arm driving mechanism 150 comprises the first arm 151, an arm base 152, and the tape head 153. The first arm 151 is provided with a rotation pipe 151*a* fitted on an arm rotation shaft 134 of the tape base 130.

As illustrated in FIGS. 5 and 8B, the first arm 151 has the rotation pipe 151*a* and an arm part 151*b*. Moreover, as illustrated in FIG. 5, the rotation pipe 151*a* is formed like a pipe, and has openings at the respective ends. Moreover, one end of the rotation pipe 151*a* is coupled to the arm base 152 abutting on one face of the tape base 130, and the other end is coupled to the arm part 151*b*. This first arm 151 is fitted on the arm rotation shaft 134 from a side on which the arm base 152 is formed. Furthermore, since the rotation pipe 151*a* is formed so that the inner diameter is slightly larger than the diameter of the arm rotation shaft 134, the rotation pipe 151*a* can rotate taking the arm rotation shaft 134 as a fulcrum.

As illustrated in FIGS. 5 and 8B, the arm part 151*b* formed at the end of the rotation pipe 151*a* extends from the end in a direction substantially orthogonal to a longitudinal direction of the rotation pipe 151*a*. Moreover, the arm part 151*b* has a holding part 151*c* formed by notching the tip of the extension. This holding part 151*c* rotatably holds the tape head 153 in conjunction with a holding part 152*c* of the arm base 152 described later.

The length in the extension direction of the arm part 151*b* is such a length that, in a state where the replacement holder 200 is mounted on the tape base 130, is shorter than a distance between the rotation pipe 151*a* and the outer peripheral face of the transfer tape wound around the feeding bobbin, and makes tensile force of the transfer tape tensioned over the tape head 153 optimum in consideration of a transfer load and transfer accuracy at the time of use of the coating film transfer tool.

As illustrated in FIGS. 5 and 8B, the arm base 152 coupled to the end of the rotation pipe 151*a* has, substantially in the center, an opening continuous with the opening of the rotation pipe 151*a*, and can be fitted on the arm rotation shaft 134 of the tape base 130. Moreover, the arm base 152 extends so as to be orthogonal to the longitudinal direction of the rotation pipe 151*a*. One side of this extension direction is a direction of extension of the arm part 151*b*, and the other side is a direction opposite to the direction of extension of the arm part 151*b*.

Further, as illustrated in FIGS. 5 and 8B, a distance of the arm base 152 from the center to one end in the direction of extension of the arm part 151*b* is substantially the same as the length of the arm part 151*b* (refer to FIG. 3). This is for causing the arm part 151*b* and the arm base 152 to hold the tape head 153 so as to be orthogonal thereto. Moreover, at the one end of the outer peripheral part of the arm base 152, namely, at a position facing the holding part 151*c* of the arm part 151*b* in the longitudinal direction of the rotation pipe 151*a*, a holding part 152*c* holding the end of the tape head 153 is formed. In the same manner as the holding part 151*c*, the holding part 152*c* is formed by notching the outer peripheral part of the arm base 152.

Further, as illustrated in FIGS. 5 and 8B, the arm base 152 is formed so that an outer peripheral part on the opposite side to a side where the holding part 152*c* is formed becomes a curved face. Further, the arm base 152 has, on the outer peripheral part, notches 152*d* and 152*e* continuous with the curved face. The notches 152*d* and 152*e* are formed in positions facing each other on the outer periphery of the arm base 152. A protrusion at the tip of an engagement piece 154 illustrated in FIG. 5 is engaged with the notch 152*d* or 152*e*.

Specifically, the arm base 152 has two notches formed approximately 180 degrees apart (FIG. 8B). By engaging the protrusion of the engagement piece 154 with one of the notches, the arm base 152 and the first arm 151 are locked so as not to rotate, either at a position where the head rotation shaft 153*a* held by the holding parts 151*c* and 152*c* is at the tip of the coating film transfer tool, or at the opposite position where the head rotation shaft 153*a* is rotated by 180 degrees from the above position.

This engagement piece 154 is pivotally supported on the fulcrum (refer to FIG. 5) disposed near the line connecting the feeding shaft 132 and the arm rotation shaft 134 on the tape base 130. The engagement piece 154 passes beside the arm rotation shaft 134, and has a protrusion at the tip. This protrusion is engaged with the notch 152*d* or 152*e* of the arm base 152, thereby regulating a rotation range of the arm base 152. In other words, when the protrusion at the tip of the engagement piece 154 is engaged with either the notch 152*d* or the notch 152*e*, even if the user intends to rotate the arm base 152 more in a specific direction, the notch 152*d* or 152*e* is caught by the protrusion of the engagement piece 154, whereby rotation in the specific direction is regulated. The rotation range of the arm base 152 will be descried later.

Further, as illustrated in FIG. 5, the tape head 153 has a pipe-like main body having openings at the respective ends, and a head rotation shaft 153*a* having a slightly smaller diameter than the openings of the main body. The respective ends in the longitudinal direction of the head rotation shaft 153*a* are held so as to be attachable to/detachable from the holding part 151*c* of the arm part 151*b* and the holding part 152*c* of the arm base 152 of the first arm 151 as described above. Taking the head rotation shaft 153*a* as a shaft, the pipe-like main body of the tape head 153 rotates. Consequently, it is possible to smoothly feed the transfer tape tensioned over the tape head 153.

Configuration of Replacement Holder

Figure 9A:
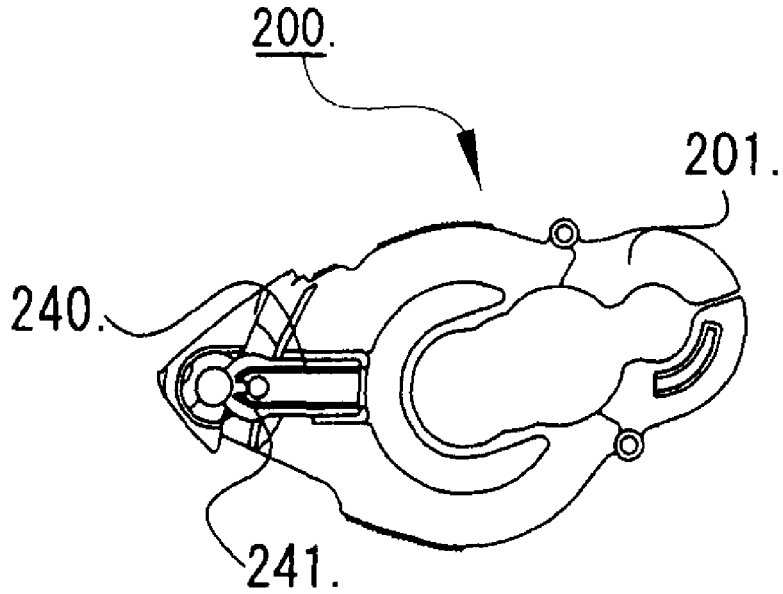
FIG. 9A is a front view illustrating the replacement holder of the coating film transfer tool in the present embodiment.
Figure 9B:
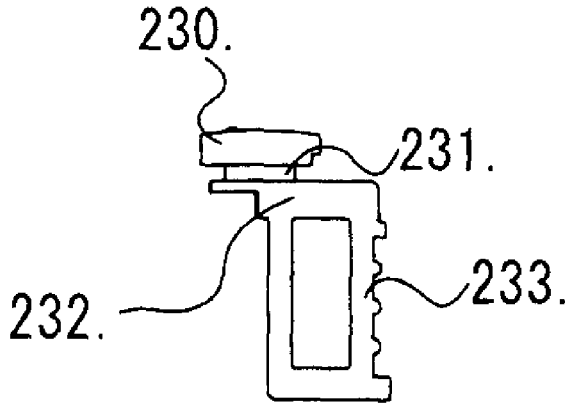
FIG. 9B is a schematic diagram illustrating the second arm, the driving gear and the tape guide of the coating film transfer tool according to the present embodiment.
Figure 10:
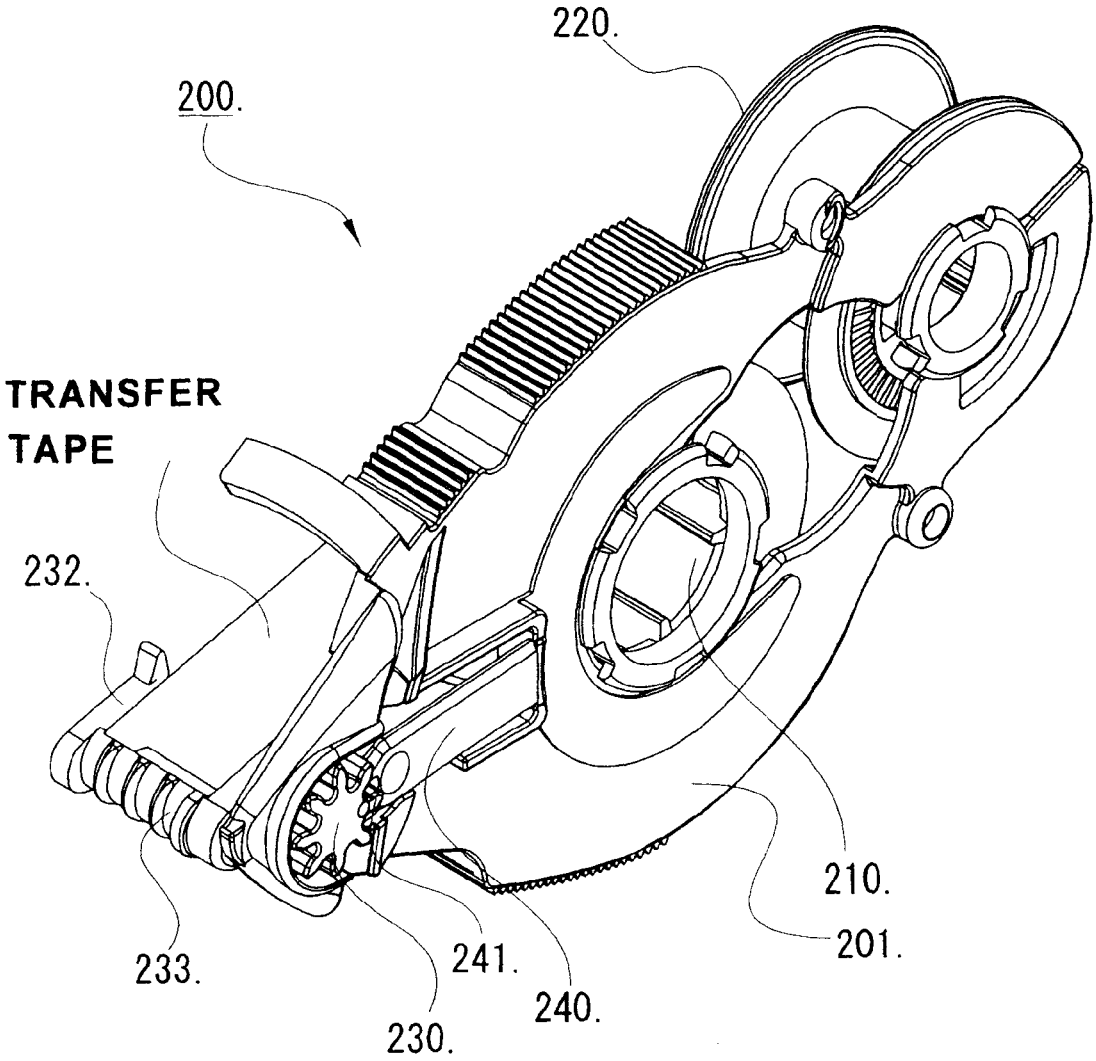
FIG. 10 is a schematic perspective view illustrating the replacement holder of the coating film transfer tool in the present embodiment.

Next, the replacement holder will be described referring to FIGS. 5, 9A, 9B and 10. FIG. 9A is a view illustrating the replacement holder of the coating film transfer tool according to the present embodiment. FIG. 9B is a schematic diagram illustrating the second arm, the driving gear and the tape guide of the coating film transfer tool according to the present embodiment. FIG. 10 is a schematic perspective view illustrating the replacement holder of the coating film transfer tool according to the present embodiment.

As illustrated in FIGS. 5, 9A, 9B and 10, the replacement holder 200 has the replacement base 201 formed like a substantially flat plane. The replacement base 201 comprises the feeding bobbin 210, the winding bobbin 220, and the driving gear 230. Around the feeding bobbin 210, the unused transfer tape is wound, substantially in the center of a surface facing the tape base 130. Around the winding bobbin 220, the used transfer tape is wound, in the vicinity of one end on the surface. The driving gear 230 rotates engaged with the engagement groove 113 of the driving cover 110*a*, in the vicinity of the other end on the surface. The second lock mechanism 240 is formed between the driving gear 230 and the feeding bobbin 210 and engaged with the driving gear 230 to inhibit rotation thereof. The feeding bobbin 210 and the winding bobbin 220 are rotatably fitted on the feeding shaft 132 and the winding shaft 133, respectively.

The replacement holder 200 has the pipe 231. The pipe 231 is coupled to the lower face of the driving gear 230 and pierced and protruded from a face of the replacement base 201 with the driving gear 230 provided, to the rear face. Moreover, the pipe 231 is formed like a pipe provided with openings at the respective ends. When the replacement holder 200 is mounted on the tape base 130, the tip of the arm rotation shaft 134 is inserted into the pipe 231.

Further, the second arm 232 extending on and along an extended line extending from the feeding bobbin 210 to the driving gear 230 and coupled to the pipe 231 (refer to FIGS. 9B and 10). This second arm 232 has substantially the same length as the arm part 151*b* of the first arm 151.

As illustrated in FIGS. 3A-3C, the second arm 232 has a shape gradually broadening from the tape guide 233 formed in one body with the tip to the arm rotation shaft 134. The gradually broadening part is engaged so as to cover the rotation pipe 151*a* illustrated in FIG. 5. In other words, when the replacement holder 200 is mounted on the tape base 130, the second arm 232 is engaged with the rotation pipe 151*a* of the first arm 151.

Further, the second arm 232 has the tape guide 233 at the tip. The tape guide 233 is placed so as to be symmetrical with the tape head 153 across the rotation pipe 151*a* and the arm rotation shaft 134. A distance between the tape guide 233 and the arm rotation shaft 134 is slightly shorter than a distance between the tape head 153 and the arm rotation shaft 134. This tape guide 233 is equivalent to one example of the "tape holder" according to the present invention.

When the driving gear 230 is rotated, the pipe 231 coupled thereto is rotated. When the pipe 231 is rotated, the second arm 232 coupled to the pipe 231 is rotated. When the second arm 232 is rotated, the first arm 151 engaged therewith is rotated taking the arm rotation shaft 134 as a fulcrum as illustrated in FIG. 3B.

Then, as illustrated in FIG. 3A, when the tape head 153 is positioned at the tip of the replacement base 201, the transfer tape is tensioned over the tape head 153. On the other hand, when the first arm 151 is rotated and the tape guide 233 is positioned at the tip, the transfer tape is tensioned over the tape guide 233 as illustrated in FIGS. 3C and 10. Here, since the tape guide 233 is slightly closer to the arm rotation shaft 134 than the tape head 153, tensile force of the transfer tape tensioned over the tape guide 233 is smaller. In this state, therefore, the user can easily replace the replacement holder 200.

As illustrated in FIGS. 9B and 10, the second lock mechanism 240 disposed between the center of the feeding bobbin 210 and the driving gear 230 on the replacement holder 200 has an arm extending in a direction from the feeding bobbin 210 to the driving gear 230. At the tip of the second lock mechanism 240, an engagement groove 241 holding a protrusion of the driving gear 230 is formed by notching the tip.

The second lock mechanism 240 engages and locks the protrusion of the driving gear 230 with the engagement groove at the tip in order to keep the tape guide 233 in the present state (position) when the first cover 110 is opened (FIG. 2B). Moreover, when the first cover 110 is closed, the second lock mechanism 240 abuts on the inner face of the first cover 110 and is pressed down thereby, the protrusion having been locked comes off the engagement groove 241 to be released.

Operation of Arm Rotation Mechanism

Next, the operation of the arm rotation mechanism in the coating film transfer tool according to the present embodiment will be described referring to FIG. 2.

First, the user presses the second cover 120 in a direction to make the hooks 122 (refer to FIG. 5) closer to each other, whereby engagement of the respective hooks 122 with the inner walls of the fixing holes 114*a* and 114*b* is released.

When the engagement of the respective hooks 122 with the inner walls of the fixing holes 114*a* and 114*b* is released, the user can open the main case 100 by rotating the first cover 110 and the second cover 120 in a separating direction.

When the first cover 110 is opened (rotated in the y-direction in FIG. 2A), the plurality of engagement grooves 113 formed on the driving cover 110*a* abut on the protrusions of the driving gear 230, and push out the protrusions in a direction in which the first cover 110 is opened. This operation is continuously performed as the first cover 110 is opened, and the driving gear 230 rotates in accordance with the number of the grooves of the engagement groove 113 on which the driving gear 230 abuts.

With rotation of the driving gear 230, the pipe 231 pierced from the face with the driving gear 230 formed of the replacement base 201 to the rear face thereof, and fixed to the driving gear 230 is rotated. With rotation of the pipe 231, the second arm 232 formed in one body with the pipe 231 is rotated.

With rotation of the second arm 232, the first arm 151 engaged with the second arm 232 is rotated. With the above operation, the tape head 153 rotates toward the feeding shaft 132 (FIG. 3B) and, instead, the tape guide 233 located in the symmetrical position with the tape head 153 is placed at the tip (on the left side on the sheet of FIG. 2) of the coating film transfer tool.

The rotational amount of the driving gear 230 is determined by the engagement groove 113 of the driving cover 110*a*. That is, when the engagement groove 113 pushes out one of the protrusions of the driving gear 230, the driving gear 230 rotates by a predetermined angle. Based on the rotational amount for this predetermined angle, the grooves of the engagement groove 113 rotate the driving gear 230 until the tape head 153 and the tape guide 233 interchange. That is, how many times the engagement groove 113 pushes out the protrusions of the driving gear 230 in the opening direction during the operation of opening the main case 100 determines the rotational amount of the driving gear 230. The engagement groove 113 rotates the driving gear 230 by such a predetermined rotational amount. In other words, the engagement groove 113 rotates the driving gear 230 until the tape guide 233 is placed in a predetermined position. When the tape guide 233 is placed in the predetermined position, engagement of the engagement groove 113 with the driving gear 230 is released.

On the other hand, when the user finishes replacement of the replacement holder 200 and performs an operation to close the main case 100 by making the first case 110 and the second case 120 close to each other, the engagement groove 113 of the driving cover 110*a* is engaged with the protrusions of the driving gear 230, and the driving gear 230 reversely rotates.

When the driving gear 230 reversely rotates, the tape guide 233 and the tape head 153 rotate and interchange. The rotational amount is the same as the rotational amount when the main case 100 is opened. At this moment, the protrusion of the engagement piece 154 is engaged with the notch 152*d* of the arm base 152, whereby rotation of the driving gear 230 is restricted.

Operation of Lock Mechanism

Next, the operation of the arm base 152 and the engagement piece 154 as the first lock mechanism and the operation of the second lock mechanism 240 will be described referring to FIGS. 2 and 4.

When the main case 100 is closed as illustrated in FIGS. 2A and 4, the notch 152*d* and the engagement piece 154 as the first lock mechanism are engaged and locked. On the other hand, the whole arm of the second lock mechanism 240 is pressed down by the driving cover 110*a*, and therefore, the engagement groove 241 of this mechanism at the tip is not engaged with the protrusion of the driving gear 230. That is, the second lock mechanism 240 is released (unlocked). As the driving cover 110*a* comes close to the second cover 120, the engagement groove 113 rotates the driving gear 230 to position the tape head 153 at the tip. Consequently, the transfer tape is tensioned (FIG. 3A).

On the other hand, when the main case 100 is opened as illustrated in FIG. 2B, the driving cover 110*a* does not abut on the second lock mechanism 240, and the protrusion of the driving gear 230 is engaged with the second lock mechanism 240. Consequently, rotation of the driving gear 230 is restricted, and the position of the tape head 153 is fixed. At this moment, the engagement groove 113 rotates the driving gear 230 as the driving cover 110*a* separates from the second cover 120, and consequently, the tape head 153 rotates about 180 degrees toward the feeding shaft 132. Moreover, the tape guide 233 rotates to be placed at the tip, whereby the transfer tape is tensioned thereover (FIG. 3C). The second lock mechanism 240 keeps this state. In other words, the second lock mechanism 240 keeps this state even when the replacement holder 200 is not mounted on the tape base 130.

Further, when the main case 100 is opened as illustrated in FIGS. 2B and 2C, the engagement piece 154 is firstly released from the notch 152*d* of the arm base 152 serving as the first lock mechanism, as the tape head 153 rotates. Next, the arm base 152 rotates with rotation of the first arm 151 and so on. When the tape head 153 rotates to a specific position, the engagement piece 154 is engaged with the notch 152*e* of the arm base 152. This notch 152*e* is in a symmetrical position with the notch 152*d* with which the engagement piece 154 is engaged when the main case 100 is closed.

As a result of this engagement, the first lock mechanism is locked to restrict rotation of the arm base 152, thereby also restricting rotation of the first arm 151.

The first lock mechanism including the arm base 152 and the engagement piece 154 and the second lock mechanism act on the respective parts, whereby it is possible to fix the positions of the tape head 153 and the tape guide 233 even if the replacement holder 200 is not mounted on the tape base 130. That is, when mounting the replacement holder 200 on the tape base 130, it is possible to mount in an appropriate position without a need to regulate the positions of the tape head 153 and the tape guide 233, so that it is possible to eliminate complications at the time of replacement.

Actions and Advantageous Effects

Actions and advantageous effects of the coating film transfer tool according to the present embodiment described above will be described.

The coating film transfer tool according to the present embodiment is configured so that, at the time of replacement of the replacement holder 200, the tape head 153 and the tape guide 233 interchange in response to the operation of opening the main case 100 or the operation of closing. Therefore, the tensioned transfer tape is brought into a loose state when the main case 100 is opened, and brought into a tense state when the main case 100 is closed.

Further, the coating film transfer tool is configured so that the transfer tape mounted on the tape base 130 is held at the tip of the tape base 130 even when the transfer tape is in the loose state.

By the aforementioned action of the coating film transfer tool according to the present embodiment, it is possible to change the tensioning state of the transfer tape of the coating film transfer tool in response to the operation of opening/closing the main case 100 based on the function of the coating film transfer tool, whereby attachment/detachment of the replacement holder 200 to/from the coating film transfer tool is facilitated, and replacement of the transfer tape is facilitated. Moreover, when using the coating film transfer tool, it is possible to hold the transfer tape in the tense state, whereby it becomes possible to avoid a problem that the coating film is transferred unevenly.

Further, in the coating film transfer tool according to the present embodiment, the driving gear 230 and the driving cover 110*a* interlock with each other, thereby being capable of rotating the arm rotation mechanism 150 disposed to the tape base 130 at the tip of the coating film transfer tool. Since a rotation range of the first arm 151 is not large, it is possible to reduce a space necessary for rotation of the first arm 151. Consequently, it is possible to prevent the coating film transfer tool from becoming large in size, and secure freedom of design.

Further, in the coating film transfer tool according to the present embodiment, the tape head 153 is disposed to the tape base 130 axially supported by the main case 100 of the coating film transfer tool. Therefore, it is efficient from the viewpoint of reuse of the members of the coating film transfer tool in replacement of the transfer tape.

Further, in the coating film transfer tool according to the present embodiment, at the time of replacement of the transfer tape with a new one, the unused transfer tape would not be pulled out excessively when the tape head 153 is rotated and the transfer tape is tensioned thereon, and it is possible to avoid that the coating film adhered to the unused transfer tape is wound up before consumed.

The coating film transfer tool according to the embodiment of the present invention can be utilized as a coating film transfer tool such as correction tape and tape glue, and can also be utilized for transfer of other coating films.

What is claimed is:

1. A coating film transfer tool comprising:

a coating film transfer tool main body; and a replacement member including a tape, wherein:

the replacement member has:

a supplier of an unused tape;

a collector of a used tape; and a tape holder including a tape guide, a driving gear, and a second arm portion, the tape holder disposed at an end away from the supplier and the collector and over which the tape fed from the supplier and collected by the collector is tensioned; and the coating film transfer tool main body has:

a first cover and a second cover;

a rotation mechanism rotatably supporting the supplier and the collector of the replacement member when the replacement member is mounted on the coating film transfer tool;

a tape base including a tape head rotation shaft receiving a first arm including a tape head thereon, the tape head rotation shaft, first arm and tape head disposed at an end of the main body corresponding with an end of replacement holder including the tape holder, the tape base receiving the replacement holder thereon such that first and second arms engage one another for rotation about the tape head rotation shaft, the tape head and the tape guide being disposed on opposite sides of the tape head rotation shaft;

wherein when the first cover is moved relative to the second cover, engagement grooves of one of the first cover or second cover engage the driving gear of the tape holder to rotate the first and second arms and the tape guide and tape head about the tape head rotation shaft such that the tape guide and tape head exchange relative positions with one another in a region surrounded by a passage of the tape fed from the mounted supplier to the mounted collector.

2. The coating film transfer tool according to claim 1, wherein:

the rotation mechanism has a feeding mechanism that is engaged with the inside of a feeding bobbin serving as the supplier and that rotatably supports the feeding bobbin, and a winding mechanism that is engaged with the inside of a winding bobbin serving as the collector and that rotatably supports the winding bobbin; and the coating film transfer tool further comprises a base member having the tape head rotation shaft on a side of the base member substantially opposite that of the winding mechanism across the feeding mechanism.

3. A coating film transfer tool comprising:

a replacement base member that rotatably supports a feeding bobbin having a tape previously wound there around and a winding bobbin winding up the tape, at one end of each of the bobbins, on a surface orthogonal to an axial direction of the bobbins; and a base member supporting on one surface an interlock mechanism that supports a feeding support engaged with the inside of the feeding bobbin and a winding support engaged with the inside of the winding bobbin at one end of each of the supports and that rotates the supports in cooperation, the replacement base member being mounted on the base member by inserting the feeding support and winding support of the base member into the feeding bobbin and winding bobbin of the replacement base member, respectively, from a side of the other end of each of the feeding bobbin and the winding bobbin, and a coating film adhered to the tape being transferred to an object of transfer, wherein the base member includes a tape head supported by a first arm member so as to be rotatable taking, as a fulcrum, a rotation shaft disposed on a surface of the base member so as to be orthogonal thereto within a predetermined angle range with respect to a line extending through the feeding support from the winding support, the first arm member being shorter in length than a distance between the fulcrum and the tape wound around the feeding bobbin; and the replacement base includes a tape guide, a second arm, and a driving gear configured for engagement with grooves of one of a first and second cover of the coating film transfer tool, the tape guide disposed on a surface of the mounted replacement base member so as to be rotated by the second arm taking a position facing a base of the rotation shaft as a fulcrum, the second arm being substantially equal in length to the first arm member, the tape guide being engaged with the rotation shaft so as to be positioned symmetrically with a tip of the tape head with respect to the rotation shaft in a direction in which the first arm member extends when the replacement base member is mounted, wherein:

the tape is tensioned over the tape head rotated to be placed at a tip of the coating film transfer tool instead of being tensioned by the tape holder by switching positions with the tape holder, wherein the tape holder rotates taking the tape head rotation shaft as a fulcrum in association with rotation of the tape head; and the tape tensioned by the tape holder becomes unattached to the tape holder having rotated taking the tape head rotation shaft as a fulcrum, in association with the rotation of the tape head when the tape is tensioned by the tape head.

4. The coating film transfer tool according to claim 3, wherein:

a first lock mechanism locking a position of the tape head when the tape head is located in the tip position or when the tape guide is located in the tip position, at the respective positions, is provided on the base member;

a second lock mechanism fixing the position of the tape guide is provided on the replacement member; and a locked state and a released state of the first lock mechanism follows a lock state or a released state of the second lock mechanism.

5. The coating film transfer tool according to claim 4, wherein, the first cover is rotatable around a fulcrum provided within a specified angle range with respect to a line extended through the feeding support from the rotation shaft, and housing part of the mounted base member and replacement member; and the second cover is rotatable around the same fulcrum as the first cover, and housing an other part of the mounted base member and replacement member.

6. The coating film transfer tool according to claim 5, wherein:

the replacement base member is placed so as to be in a position facing the base of the rotation shaft when mounted on the base member, has a hole fitted with the tip of the rotation shaft when mounted, has the second arm provided with the tape guide at one end on one face of the base member, has the driving gear rotating the rotation shaft by engagement with the plurality of engagement grooves at the other end, and has a pipe-like rotation member form through the replacement base member;

the second lock mechanism is released from the locked state by the first cover or second cover provided with the plurality of engagement grooves in synchronism with the engagement of the plurality of engagement grooves with the driving gear;

in conjunction with the operation of opening the first cover or second cover provided with the engagement grooves, the first lock mechanism is unlocked, and the tape guide and tape head are rotated as the driving gear rotates the rotation shaft in a position corresponding to an end of the coating film transfer tool, and when the tape guide reaches a position of the tip, the second lock mechanism and the first lock mechanism are locked; and in conjunction with the operation of housing the replacement base member into the first cover or second cover provided with the engagement grooves, the second lock mechanism and the first lock mechanism are unlocked, and the tape guide and tape head rotate, and when the tape head reaches a position of the tip, the first lock mechanism is locked.

* * * * *